US006918636B2

(12) United States Patent
Dawood

(10) Patent No.: US 6,918,636 B2
(45) Date of Patent: Jul. 19, 2005

(54) COAL AND ROCK CUTTING PICK

(75) Inventor: Albert Daniel Dawood, Cherrybrook (AU)

(73) Assignee: AGE Mining Services Pty Ltd, Mayfield (AU)

( * ) Notice: Subject to any disclaimer, the term of this patent is extended or adjusted under 35 U.S.C. 154(b) by 0 days.

(21) Appl. No.: 10/344,067

(22) PCT Filed: Aug. 7, 2001

(86) PCT No.: PCT/AU01/00960

§ 371 (c)(1),
(2), (4) Date: Jul. 22, 2003

(87) PCT Pub. No.: WO02/12677

PCT Pub. Date: Feb. 14, 2002

(65) Prior Publication Data

US 2003/0234569 A1 Dec. 25, 2003

(30) Foreign Application Priority Data

Aug. 7, 2000 (AU) ..... 51846/00

(51) Int. Cl.[7] ..... E21C 35/18
(52) U.S. Cl. ..... 299/112 T; 299/101; 299/108
(58) Field of Search ..... 299/100, 101, 299/108–109, 112 R, 112 T, 106–107, 110–111, 102–105, 79.1, 87.1

(56) References Cited

U.S. PATENT DOCUMENTS

| | | | | |
|---|---|---|---|---|
| 1,573,505 A | | 2/1926 | Radford | |
| 3,239,275 A | * | 3/1966 | Belugou | 299/112 R |
| 3,357,117 A | * | 12/1967 | Petersen | 37/449 |
| 4,274,677 A | | 6/1981 | Proctor | 299/92 |
| 4,415,208 A | | 11/1983 | Goyarts | 299/91 |
| 4,915,455 A | | 4/1990 | O'Neill et al. | 299/91 |
| 5,235,961 A | | 8/1993 | McShannon | |
| 5,520,444 A | | 5/1996 | Kosobrodov et al. | 299/106 |

FOREIGN PATENT DOCUMENTS

| | | | |
|---|---|---|---|
| AU | 12672/97 | | 4/1997 |
| DE | 2605986 | | 8/1977 |
| GB | 1573505 | * | 8/1980 |
| GB | 2 121 087 A | | 12/1983 |

OTHER PUBLICATIONS

Dawood, A. D., "The Design of Coal and Rock Cutting Systems With Particular Reference to Debris Size Distribution", The University of New South Wales School of Mining Engineering, Faculty of Applied Science, vols. I and II, Oct. 1984, pp. 1–429 and Appendices.

* cited by examiner

*Primary Examiner*—Sunil Singh
(74) *Attorney, Agent, or Firm*—Brinks Hofer Gilson & Lione

(57) ABSTRACT

The pick (1) includes a radially inner end (4) and a shank (3) to be fixed to the drum (10) to substantially prevent relative movement between the pick (1) and drum (10). The pick (1) further includes a cutting head (2) having leading (5) and trailing faces (6) intersecting to provide a cutting edge (8) to extend generally parallel to an axis. The leading face (5) in use is inclined by an acute rake angle R to a radius of the axis, with the trailing face (6) being inclined at an acute back clearance angle B to a plane passing through the edge (8) and normal to the radius. The leading face (5) and trailing face (6) being inclined by an acute angle and the shanks when fixed to the drum (10) extends at an acute angle to the radius.

9 Claims, 12 Drawing Sheets

COAL AND ROCK CUTTING PICK

CROSS REFERENCE TO RELATED APPLICATIONS

This application claims priorty to PCT application No. PCT/AU01/00960, filed Aug. 7, 2001, which claims priorty to Australian provisional application no. 51846/00, filed Aug. 7, 2000.—therein.

TECHNICAL FIELD

The present invention relates to coal mining and in particular to cutting picks for use in coal and rock excavation.

BACKGROUND OF THE INVENTION

Coal and rock excavation is typically carried out using an array of picks deployed at intervals on a continuous miner or a shearer having a rotating cutting drum. The picks cut the coal face as they come into contact with it during rotation of the drum.

Most currently available picks have a conical tool shape with a pointed tool tip. Conical picks do not actually cut, but rather crush the coal face, resulting in low coarseness of the product and the generation of a large amount of airborne dust particles. In fact, the resultant action generates dust and small fragments (fines) which require the use of continuous water sprays to meet Occupational Health and Safety conditions. These fine dust particles are a common health hazard to underground miners. As the particle size may fall into the carcinogenic and/or respiratory hazard ranges, miners subject to prolonged exposure can become susceptible to lung cancer, chronic bronchitis and pneumoconiosis. The large volumes of dust generated can also have an adverse effect on equipment reliability, resulting in increased equipment maintenance costs.

The conical picks are only loosely held in their respective holders so they are free to rotate about their longitudinal axis. Studies showed that these picks do indeed fail after locking up in their holders due to fine dust generation and therefore rotation was prevented. This action splinters the coal and rock, generating fines and frictional ignition.

Australian Patent Application No. 2672/97 published on 4 Sep. 1997, which is incorporated herein by reference, discloses a coal and rock cutting pick of chiseled shaped comprising a straight cutting edge which delimits substantially planar front and bottom faces of the cutting pick, the plane of the bottom face being inclined at an acute back clearance angle to a cutting plane and the front face being inclined at an acute front rake angle to an axis perpendicular to the cutting plane such that the front bottom faces define an acute angle at the cutting edge. However, the picks disclosed in this document are mounted to the drum with the shank of the pick extending radially from the drum. This causes the pick to be subject to large shear forces as the pick contacts the cutting surface. The pick also includes a rotating cutting head.

The above statements regarding prior discloses are not to be taken to be admissions of what was well known in the field of coal mining

OBJECT OF THE INVENTION

It is an object of the present invention to provide an optimum cutting edge orientation to reduce the generation of air borne dust particles during cutting operations.

SUMMARY OF THE INVENTION

Accordingly, in a first aspect, the present invention provides a cutting pick assembly for mounting on a rotatable drum, said drum having a longitudinal axis of rotation, said pick assembly comprising a pick holder and a pick having a longitudinal axis, said pick having:

a non rotating cutting head having a straight cutting edge which delimits substantially planar front and trailing faces of said head;

a securing end engaged within said pick holder to secure said pick relative to said drum so that in use, rotation of said drum drives said cutting edge forward in a generally circular path and so that said pick is prevented from moving substantially relative to said drum; and a shank extending along said longitudinal axis between said cutting head and said securing end, said pick assembly being oriented such that said trailing face is inclined at an acute back clearance angle of about 7 to 15 degrees to a cutting plane, which is defined by a tangent to said circular path at said cutting edge, said front face is inclined at an acute front rake angle of about 10 to 45 degrees to an axis perpendicular to said cutting plane such that said front and trailing faces define an acute angle at said cutting edge, and said cutting edge is maintained in a fixed orientation relative to said drum and substantially parallel to said longitudinal axis;

characterised in that both said front and trailing faces converge outwardly with respect to said drum toward said longitudinal axis of extension and wherein said pick holder and said pick are adapted so that said longitudinal axis is inclined by an acute angle extending rearwardly to said cutting plane.

In a second aspect, the present invention provides a rotatable drum having at least one pick holder and at least one cutting pick mountable in said pick holder, said pick having a longitudinal axis and including:

a non rotating cutting head having a straight cutting edge which delimits substantially planar front and trailing faces of said head;

a securing end engaged within said pick holder to secure said pick to said drum so that in use, rotation of said drum drives said cutting edge forward in a generally circular path and so that said pick is prevented from moving substantially relative to said drum; and a shank extending along said longitudinal axis between said cutting head and said securing end, said pick being oriented in said pick holder such that said trailing face is inclined at an acute back clearance angle of about 7 to 15 degrees to a cutting plane which is defined by a tangent to said circular path at said cutting edge, said front face is inclined at an acute front rake angle of about 10 to 45 degrees to an axis perpendicular to said cutting plane such that said front and trailing faces define an acute angle at said cutting edge, and said cutting edge is maintained in a fixed orientation relative to said drum and substantially parallel to said longitudinal axis;

characterised in that both said front and trailing faces converge outwardly with respect to said drum toward said longitudinal axis of extension and wherein said pick and said pick holder are adapted so that said longitudinal axis is inclined by an acute angle extending rearwardly to said cutting plane.

The pick may be mountable in the pick holder at an acute angle to the radius of the drum and inclined toward the direction of rotation of the drum.

a straight cutting edge which delimits substantial planar front and trailing faces of said head, said trailing face being inclined at an acute back clearance angle of about 7 to 15 degrees to a cutting plane which is defined by a tangent at said cutting edge, and said front face being inclined at an acute front rake angle of about 10 to 45 degrees to an axis perpendicular to said cutting plane such that said front and trailing faces define an acute angle at said cutting edge, a securing end adapted to secure said pick to said drum, so that in use, rotation of said drum drives said cutting edge in a generally circular path, and a shank which connects said cutting head and said securing end, and wherein said pick is adapted to engage the drum so that said pick is prevented from moving relative to said drum so that said cutting edge is maintained in a fixed orientation relative to said drum and substantially parallel to said longitudinal axis.

Preferably, the cutting pick is manufactured from an air hardened die cast steel.

Preferably, the back clearance angle is between 8 and 10 degrees.

Preferably, the front rake angle is between 10and 30 degrees.

Preferably, the width of the cutting edge is between 5 mm and 60 mm.

Preferably, the securing end has a T shaped profile to slidably engage a channel and fasten to the pick holder.

BRIEF DESCRIPTION OF THE DRAWINGS

A preferred form of the present invention will now be described, by way of example only, with reference to the accompanying drawings wherein:

FIGS. 1C to 1E are cross sectional views of the coal and rock cutting picks as shown in FIGS. 1A, 1B along lines a—a, b—b and c—c;

DESCRIPTION OF NUMERALS

Figure 1:
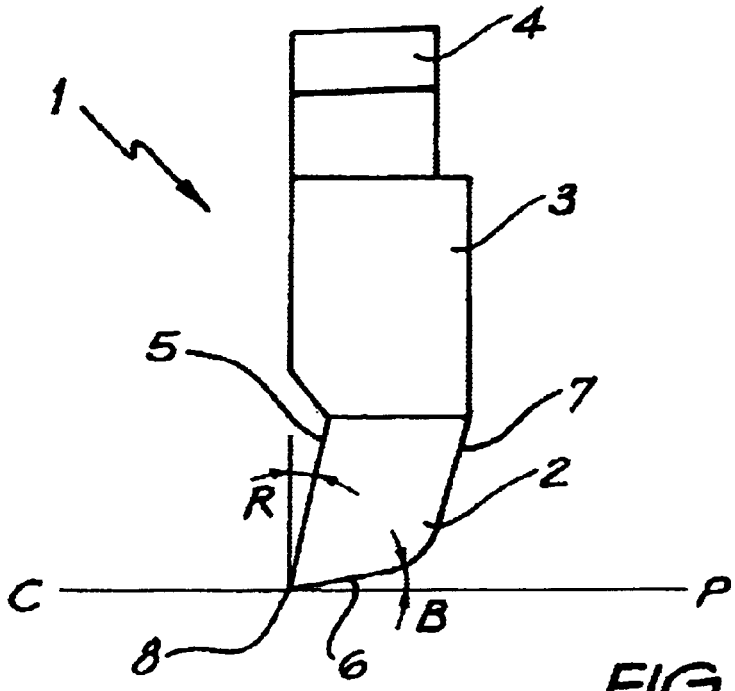
FIG. 1 PRIOR ART
FIG. 1 (prior art) is a side elevational view of a coal and rock cutting pick.
Figure 2:
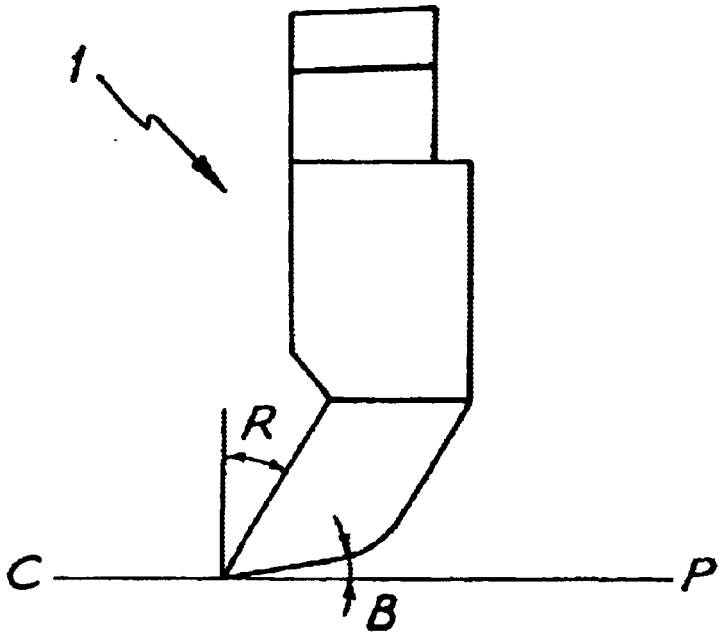
FIG. 2 PRIOR ART
FIG. 2 (prior art) is a side elevational view of another coal and rock cutting pick.
Figure 3:
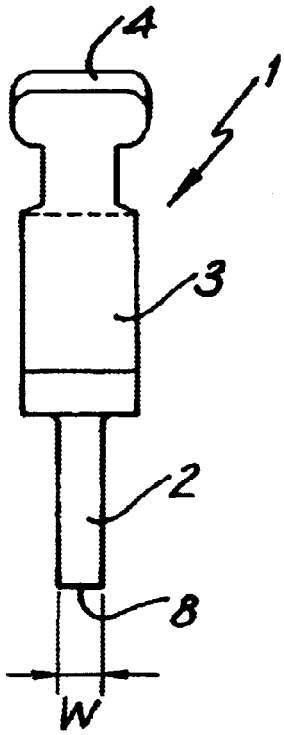
FIG. 3 PRIOR ART
FIG. 3 (prior art) is a front elevational view of a coal and rock cutting pick.
Figure 4:
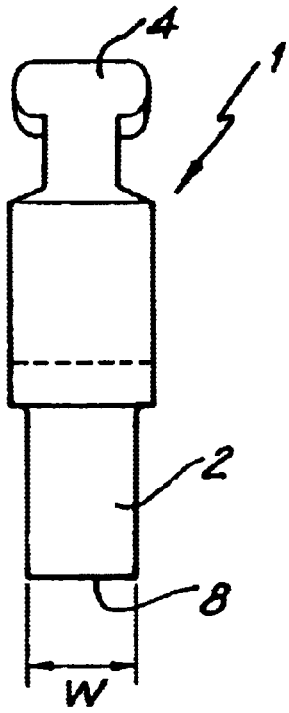
FIG. 4 PRIOR ART
FIG. 4 (prior art) is a rear elevational view of another coal and rock cutting pick.
Figure 5:
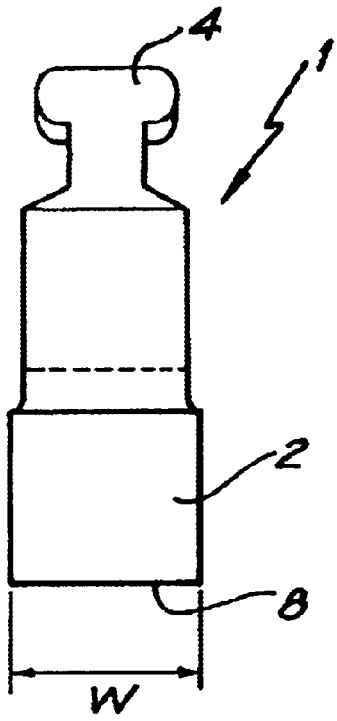
FIG. 5 PRIOR ART
FIG. 5 (prior art) is a rear elevational view of yet another coal and rock cutting pick.
Figure 6:
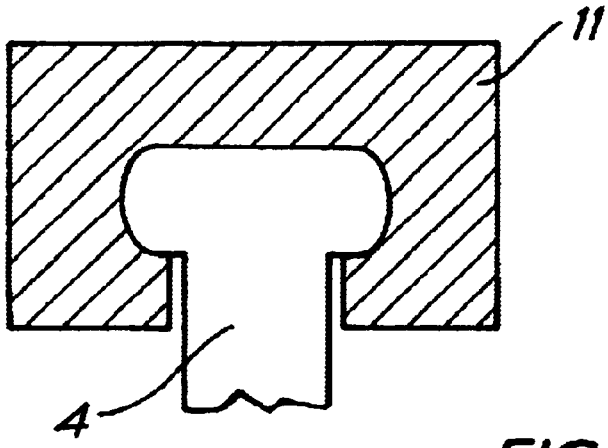
FIG. 6 PRIOR ART
FIG. 6 (prior art) is a cross sectional view of a coal and rock cutting pick having a securing end in a pick holder.

Number 1 is a cutting pick;

Number 2 is a cutting head;

Number 3 is a shank;

Number 4 is a securing (inner) end;

Number 5 is a planar front (leading) face;

Number 6 is a planar bottom (trailing) face;

Number 7 is a rear face;

Number 8 is a straight cutting edge;

Number 9 is a spiral vane for the placement of pick holders;

Number 10 is a rotating drum;

Number 11 is a pick holder;

Number 12 is a clearance (Face) Ring;

Number 13 is a coal face; and

Number 14 is a shearer mining machine.

Letter R is a front rake angle;

Letter B is a back clearance angle;

Letter W is a width of cutting edge (head);

Letter S is a spacing between two adjacent picks;

Letter P is cutting drum radius;

Letter D is the depth of cut;

Letter X is the longitudinal axis;

Letter Z is the acute angle; and

Line CP is the cutting plane.

DETAILED DESCRIPTION OF THE PREFERRED EMBODIMENTS

Referring to the Figures there is disclosed a cutting pick 1 having a cutting head 2, shank 3 and securing (inner) end 4 adapted to attach the cutting pick 1 to a pick holder 11. In FIGS. 1 to 10, pick holder 11 is welded to the spiral vane 9 which likewise is welded to a rotating drum 10. In these figures, the securing end 4 is of a "T" shaped configuration, adapted to be slidably engaged and fastened in the channel of a pick holder 11 located on the spiral vane 9 of the rotating drum 10. The drum can be for a shearer or a continuous miner.

Figure 13A:
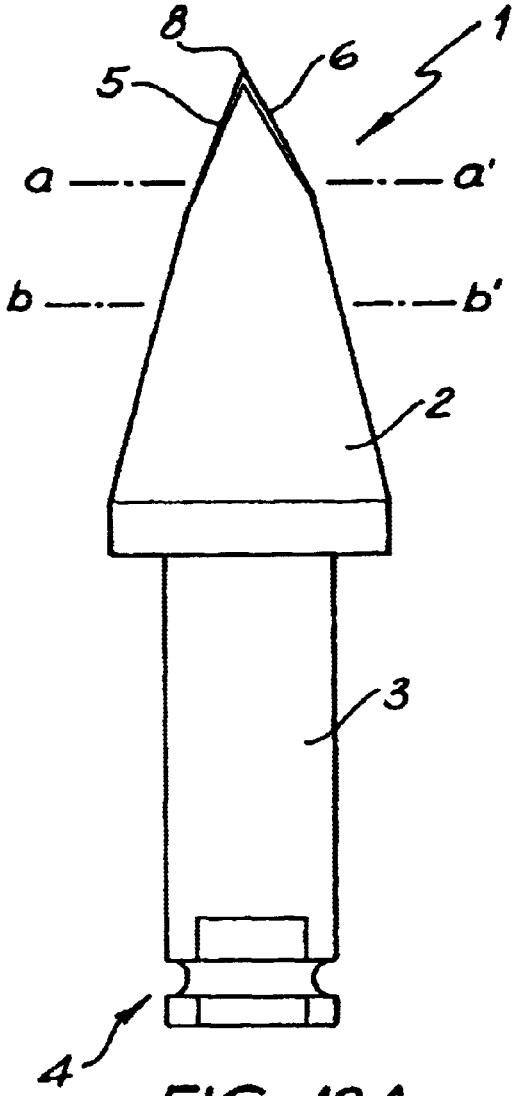
FIGS. 13A and 13B are front and side elevational views of further coal and rock cutting picks.
Figure 13B:
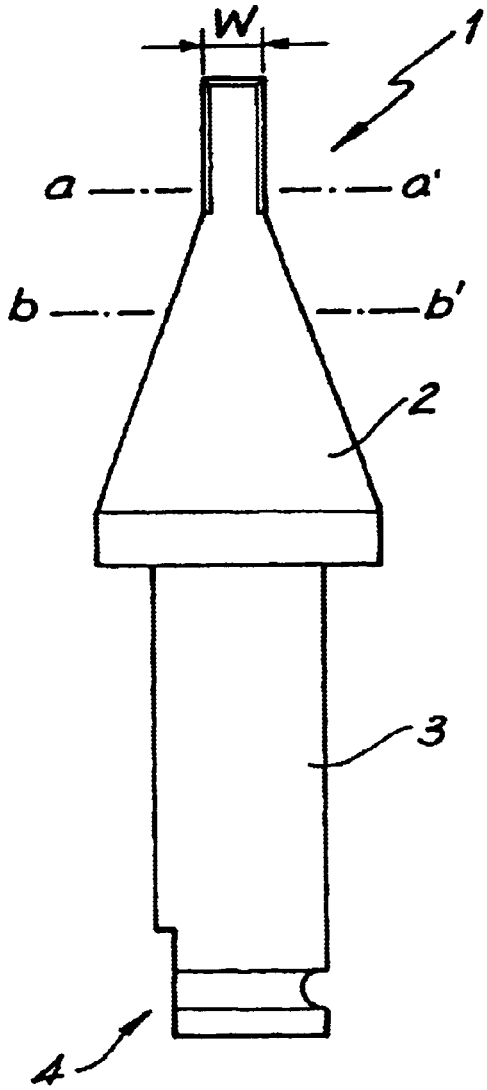
Figure 13C:
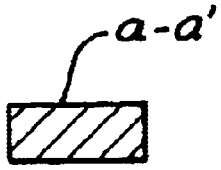
FIGS. 13C and 13D are cross sectional views of the coal and rock cutting picks as shown in FIGS. 13A, 13B along lines a—a and b—b.
Figure 13D:
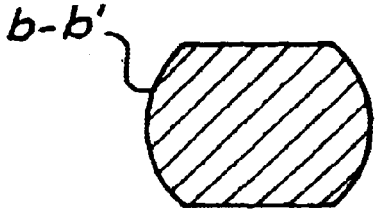
Figure 14A:
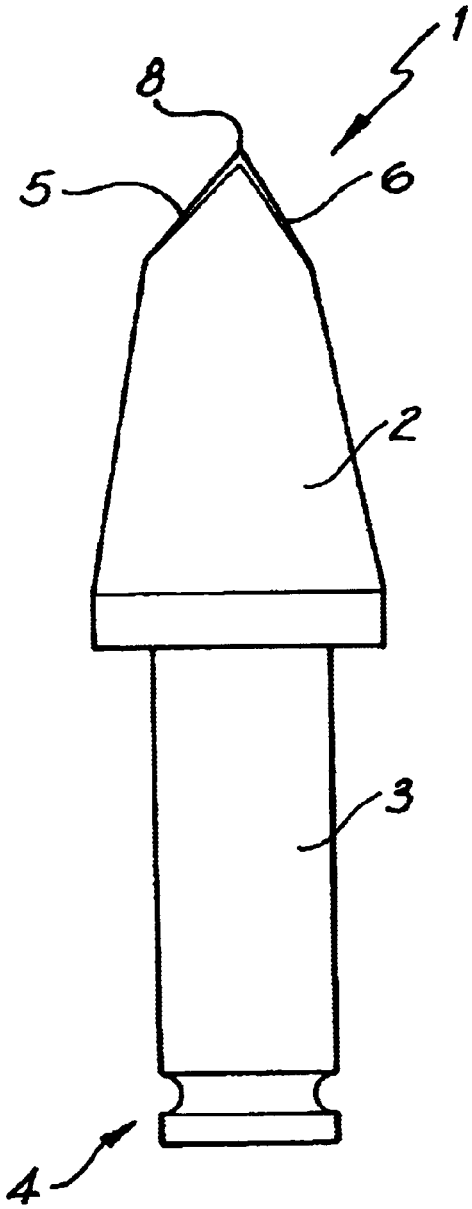
FIGS. 14A and 14B are front and side elevational views of further coal and rock cutting picks.
Figure 14B:
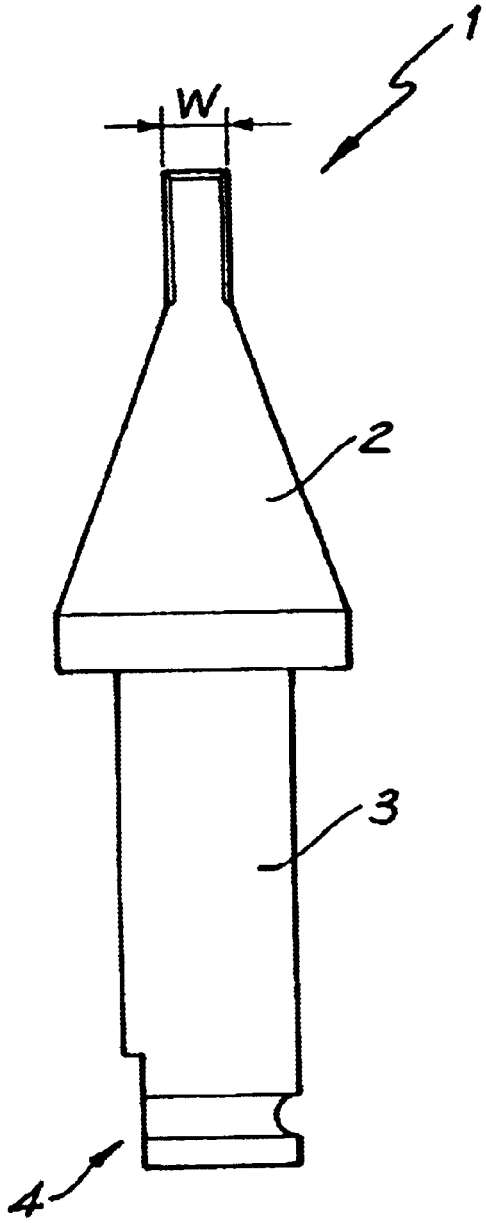
Figure 15A:
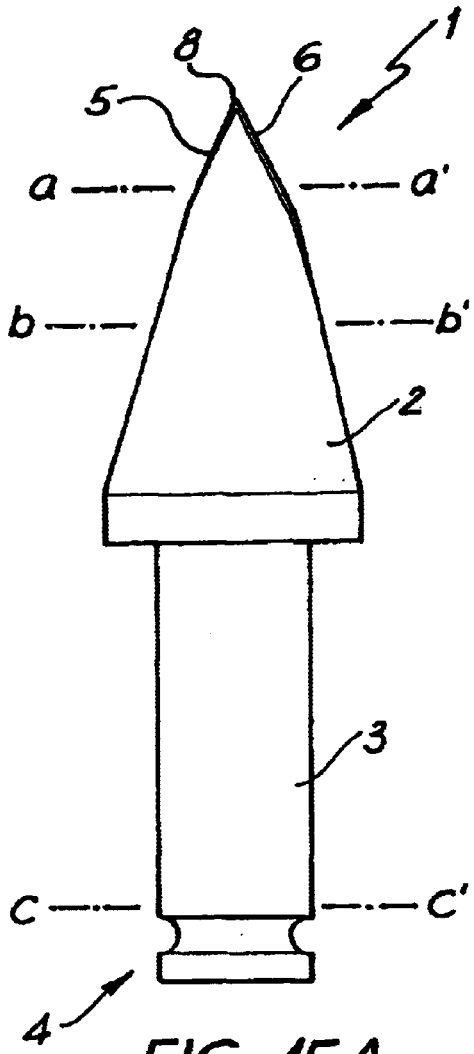
FIGS. 15A and 15B are front and side elevational views of further coal and rock cutting picks.
Figure 15B:
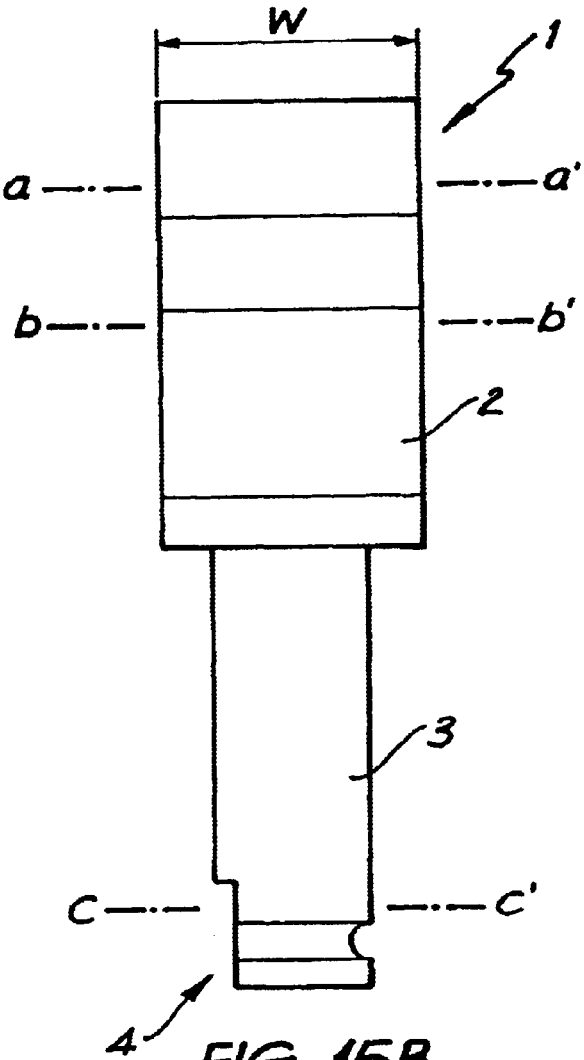
Figure 15C:
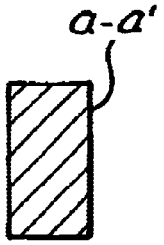
FIGS. 15C and 15E are cross sectional views of coal and rock cutting picks as shown in FIGS. 15A and 15B along lines a—a, b—b and c—c.
Figure 15D:
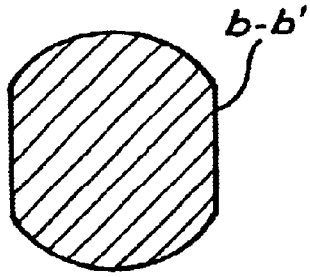
Figure 15E:
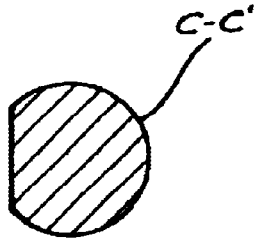
Figure 16A:
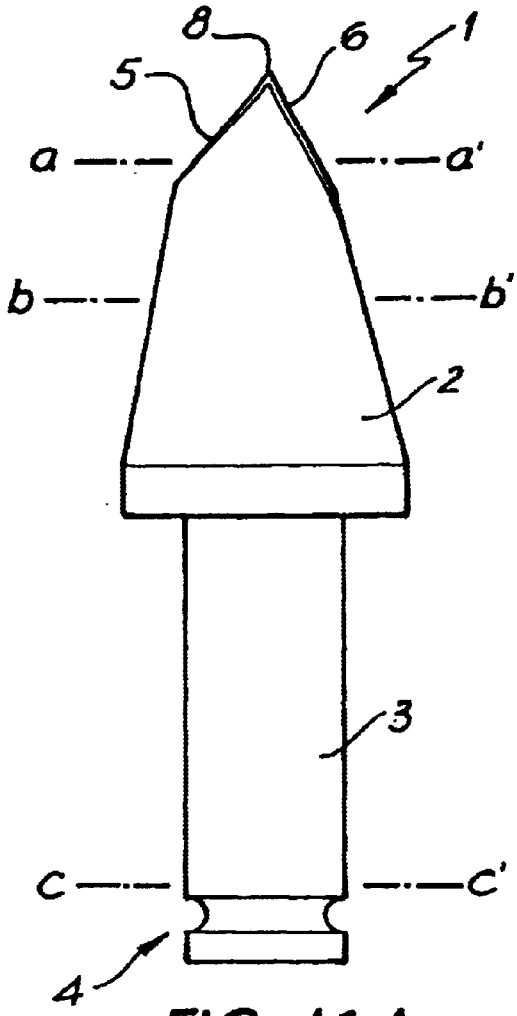
FIGS. 16A and 16B are front and side elevational views of further coal and rock cutting picks.
Figure 16B:
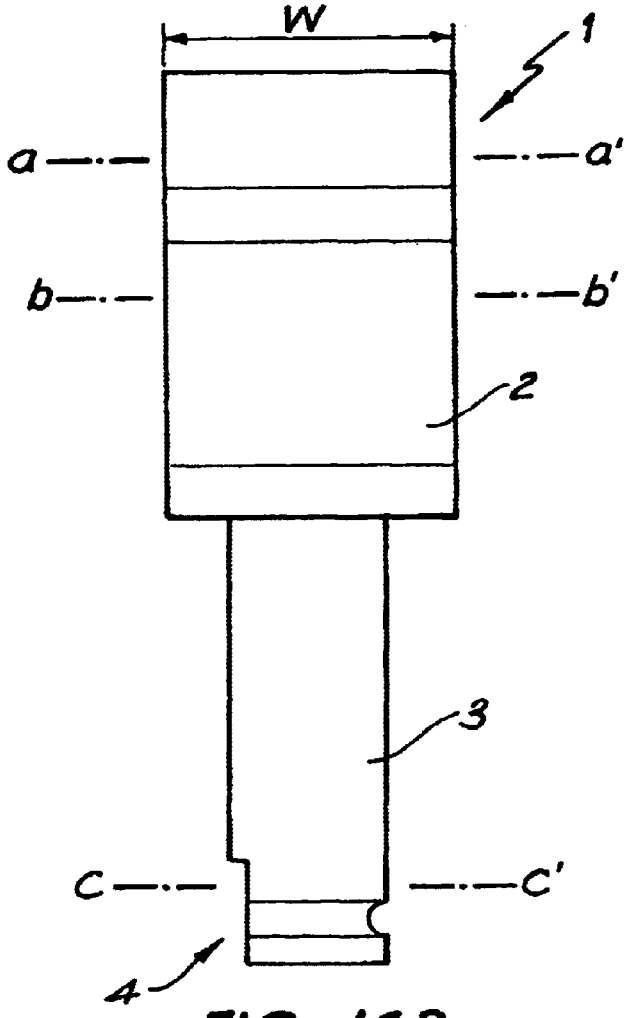
Figure 16C:
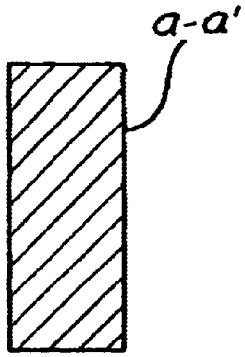
FIGS. 16C and 16E are cross sectional views of coal and rock cutting picks as shown in FIGS. 16A and 16B along lines a—a, b—b and c—c.
Figure 16D:
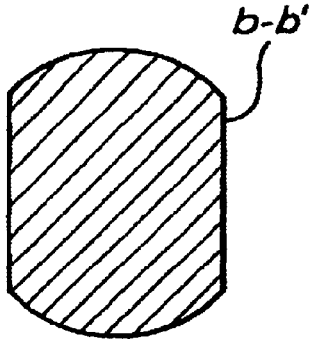
Figure 16E:
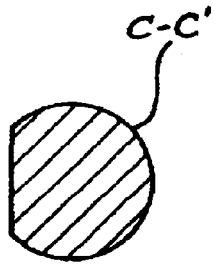

The whole body of the cutting pick 1 is preferably made of an homogenous unattached bar of steel alloy, fabricated from low alloy steel 4340, air hardened and tempered to about 60 HR'C' Rockwell surface hardness. Picks in FIGS. 11A,B, 12A,B, 15A,B and 16A,B are designed to preferably cut coal, whilst picks in FIGS. 13A,B and 14A,B are designed for cutting hard rocks.

The pick 1 includes a radially inner end 4 and a shank 3 to be fixed to the drum 10 to substantially prevent relative movement between the pick 1 and drum 10. The pick 1 further includes a cutting head 2 having leading and trailing faces 5,6 intersecting to provide a cutting edge 8 to extend generally parallel to an axis. The leading face 5 in use is inclined by an acute rake angle R to a radius of the axis, with the trailing face 6 being inclined at an acute back clearance angle B to a plane passing through the edge 8 and normal to the radius. The leading face 5 and trailing face 6 converge outwardly with respect to the drum 10 toward the longitudinal axis X of extension and wherein the pick 1 and pick holder 11 are adapted so that the longitudinal axis X is inclined by an acute angle Z extending rearwardly to said cutting plane CP as best seen in FIG. 18.

Figure 11A:
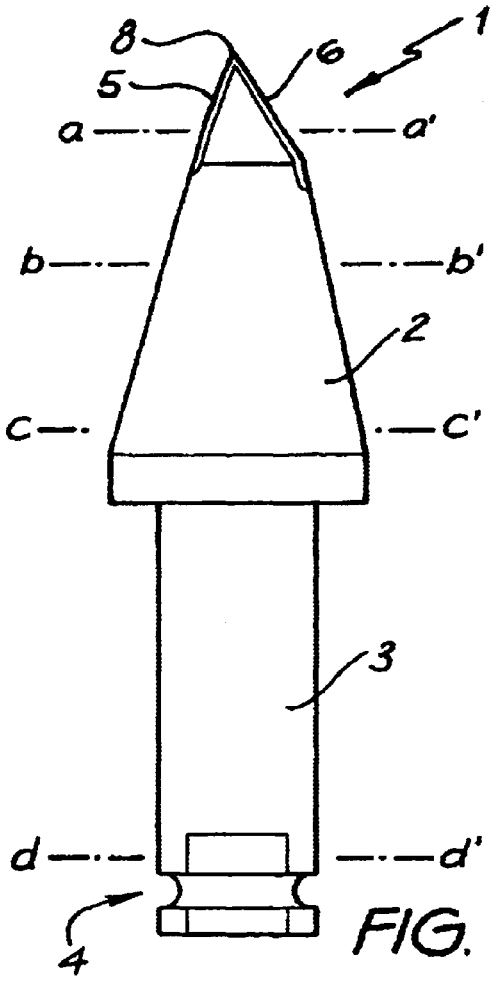
FIGS. 11A and 11B are front and side elevational views of coal and rock cutting picks of embodiments of the present invention.
Figure 11B:
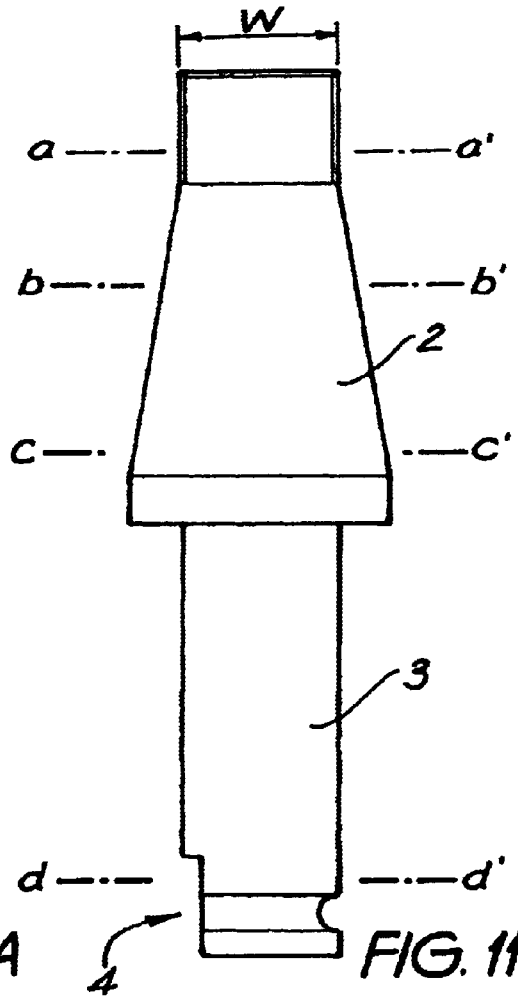
Figure 11C:
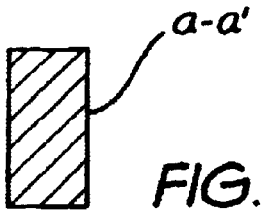
FIGS. 11C to 11F are cross sectional views of the coal and rock cutting picks as shown in FIGS. 11A and 11B along lines a—a, b—b, c—c and d—d.
Figure 11D:
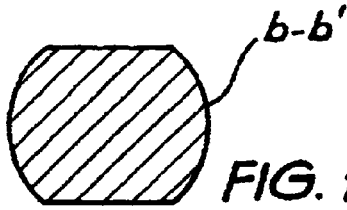
Figure 11E:
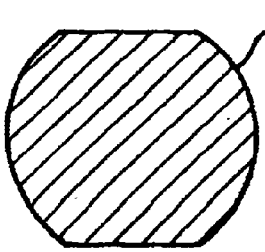
Figure 11F:
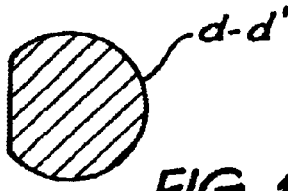
Figure 12A:
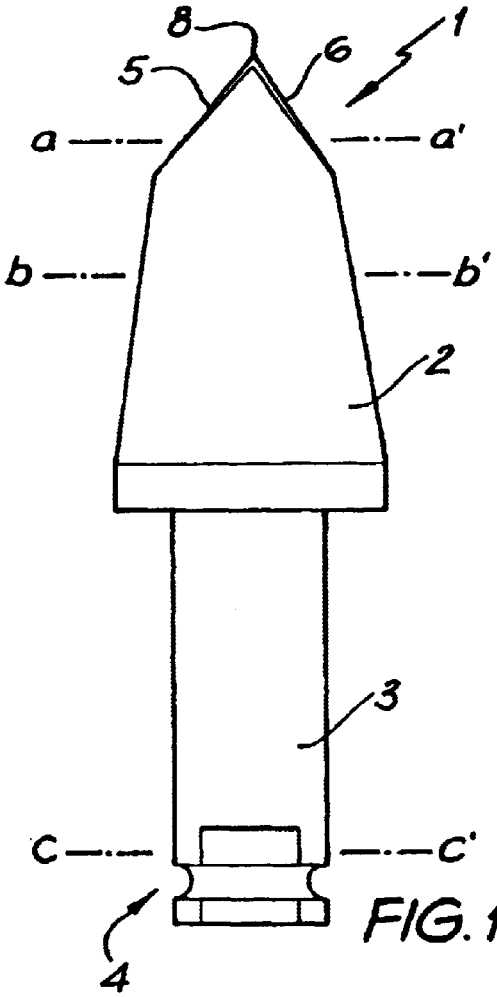
FIGS. 12A and 12B are front and side elevational views of further coal and rock cutting picks.
Figure 12B:
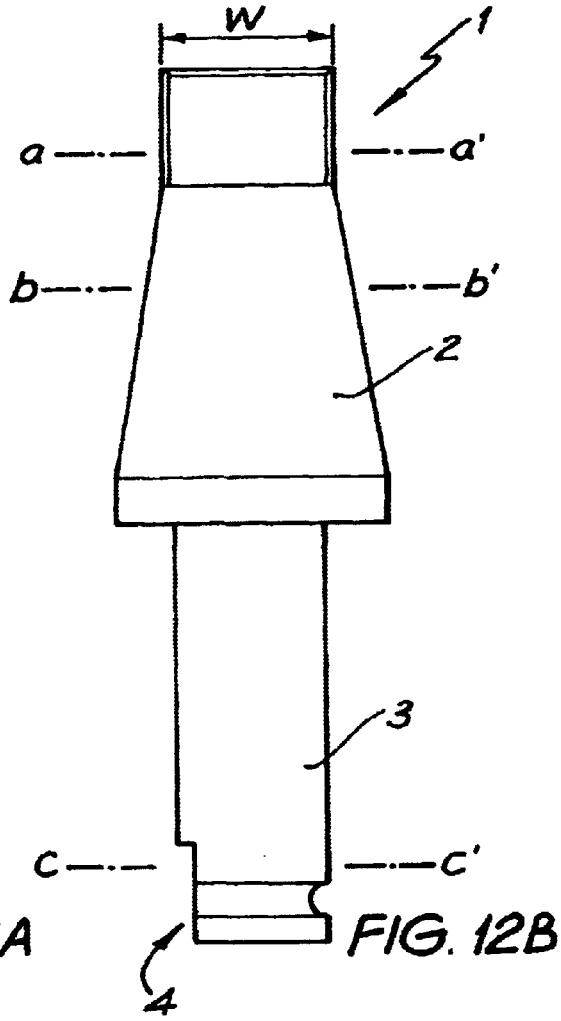
Figure 12C:
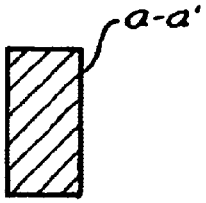
Figure 12D:
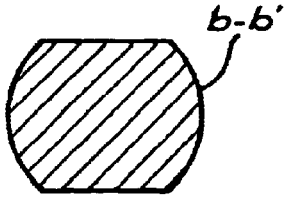
Figure 12E:
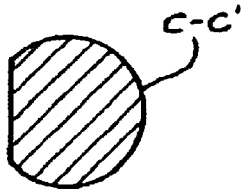
Figure 17:
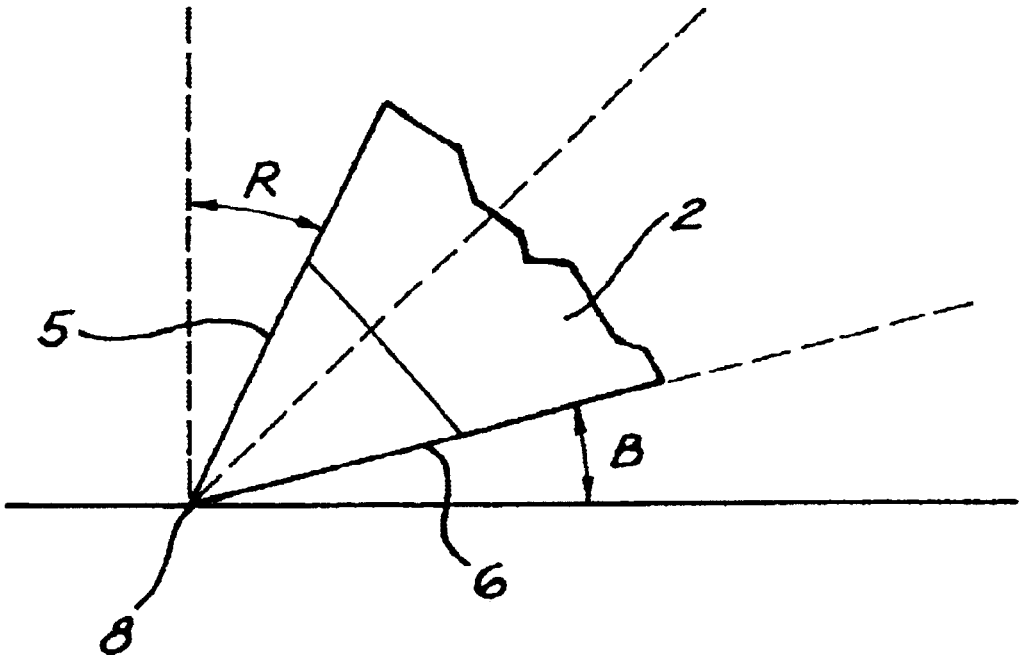
FIG. 17 is partial cut-away view of a tip of a pick.

As best seen in FIG. 17, the front face 5 is inclined at a front rake angle R to an axis perpendicular to the cutting plane CP. FIG. 11A shows a front rake angle R of 30 degrees, whilst FIG. 12A shows a front rake angle R of 10 degrees, for example.

The width W of the cutting head 2, corresponding to the length of the cutting edge 8 is selected depending upon the material to be cut and the location of the cutting pick 1 on the rotating drum 10. Narrower cutting heads 2 (for example, FIG. 13B) being used for cutting harder rock faces such as granite. FIGS. 11B, 12B, 13B, 14B, 15B and 16B show cutting picks 1 and cutting heads 2 having widths W of 30, 30, 10, 10, 50 and 50 mm respectively.

Figure 18:
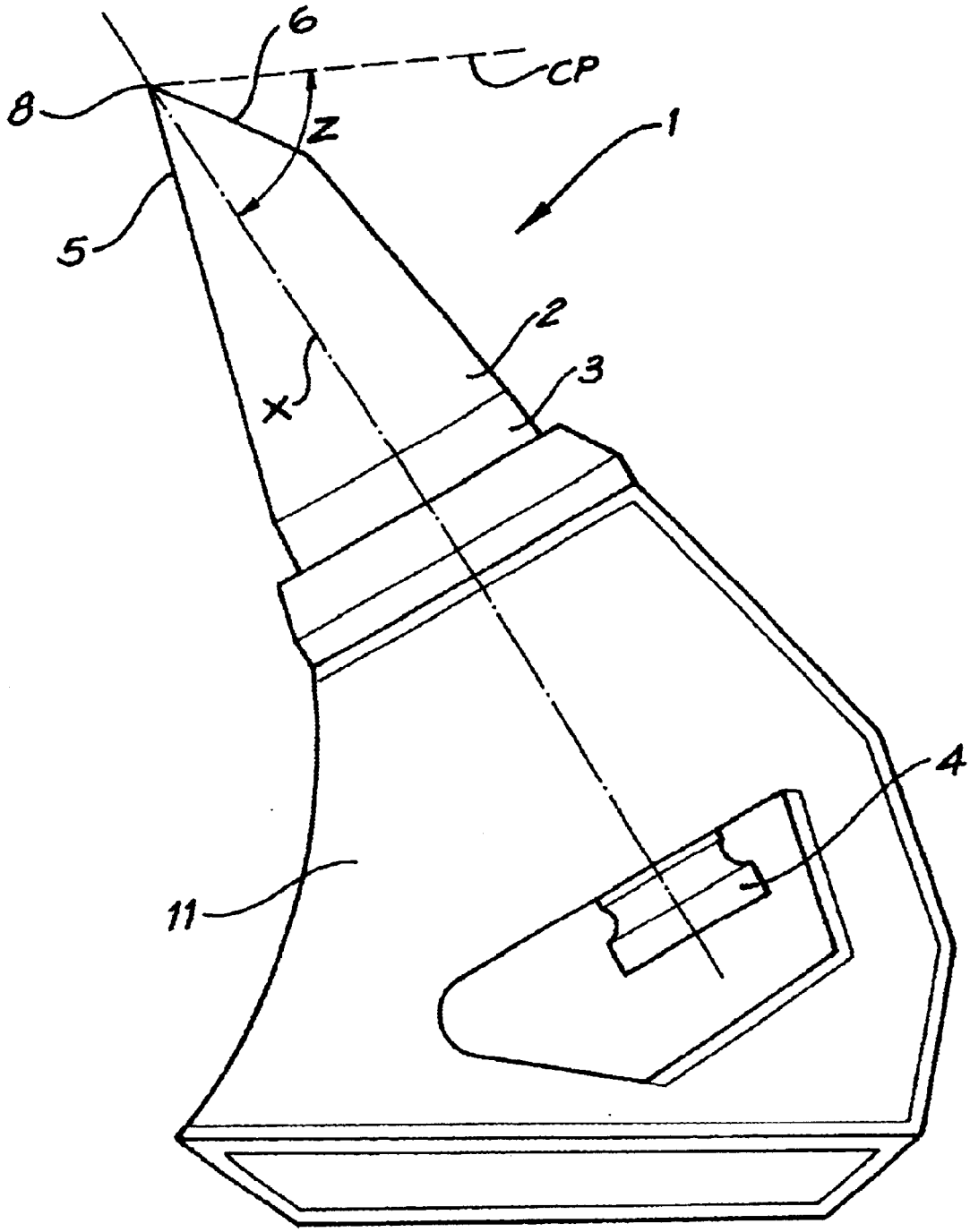
FIG. 18 is a side elevational view of another coal and rock cutting pick secured in a pick holder.

As shown in FIG. 18, the pick has a longitudinal axis X and the inner end 4 and shank 3 extending along said longitudinal axis X and adapted for engagement with a holder 11. The engagement is such that rotation of the drum 10 drives the cutting pick 1 forward in a circular path with a tangent of the path at the cutting edge 8 defining the cutting plane CP. The securing end arrangement allows for simple replacement of worn cutting picks 1. Other similar means of attachment may be employed at the securing end 4 which will rigidly fix the cutting pick 1 to the rotating drum 10 whilst allowing pick 1 to be replaced.

Figure 7:
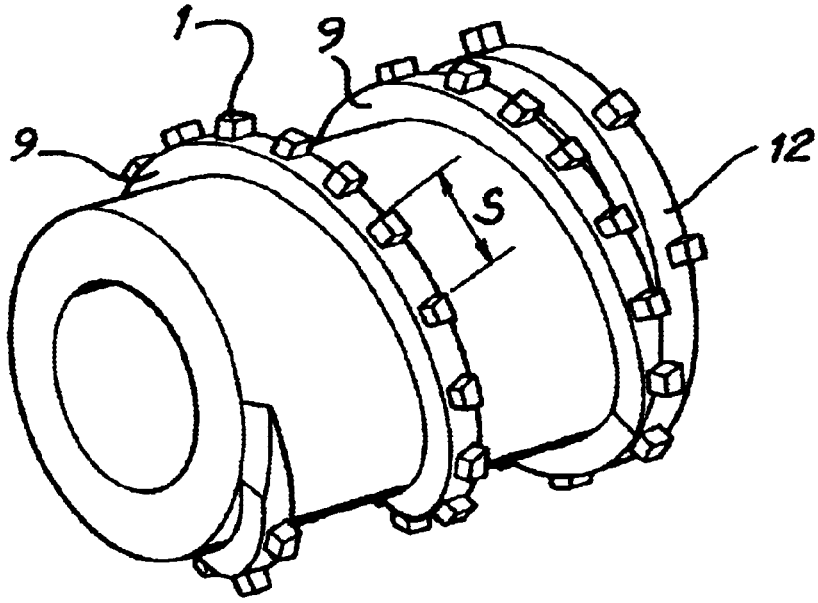
FIG. 7 PRIOR ART
FIG. 7 (prior art) is a perspective view of a rotating drum with an arrangement of coal and rock cutting picks.
Figure 8:
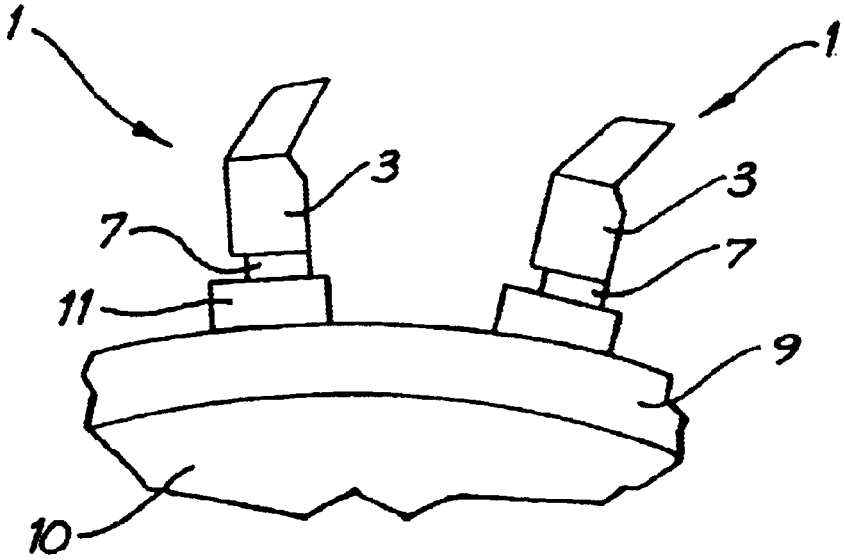
FIG. 8 PRIOR ART
FIG. 8 (prior art) is an end elevational view of a section of a rotating drum with an arrangement of coal and rock cutting picks.
Figure 9:
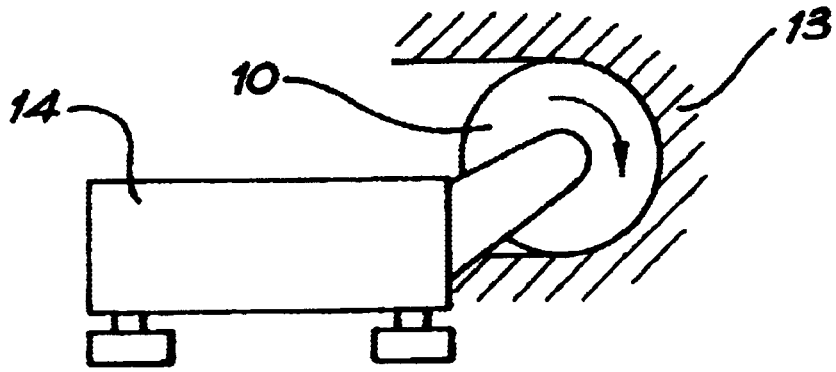
FIG. 9 PRIOR ART
FIG. 9 (prior art) is an end elevational view of a shearer with a rotating drum.
Figure 10:
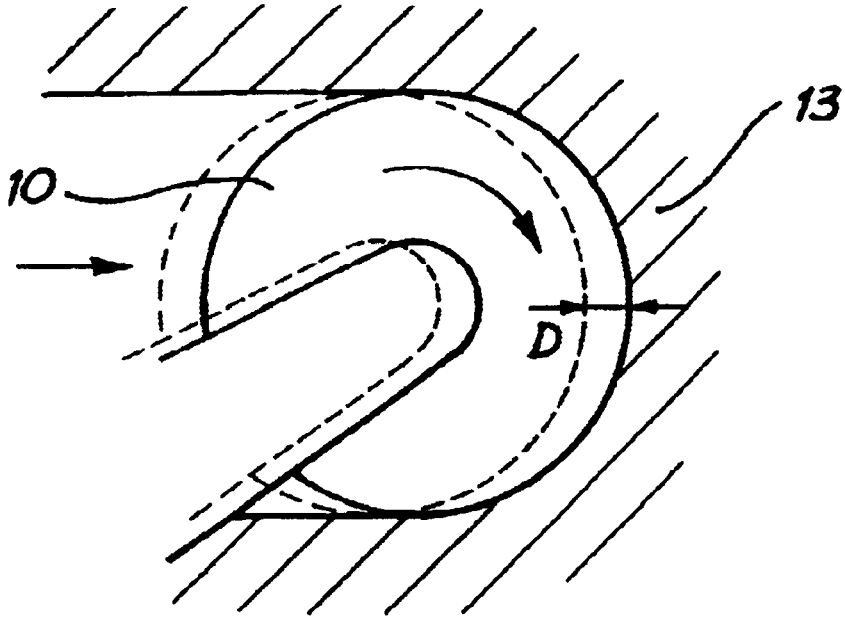
FIG. 10 PRIOR ART
FIG. 10 (prior art) is an end elevational view of a rotating drum depicting a cutting depth.

As shown in FIG. 7, in use, a plurality of the cutting picks 1 are arranged on a spiral vane 9 on the rotating drum 10 attached to a shearer 14. The arrangement preferably being such that a series of cutting picks 1 follow the same path with adjacent cutting picks 1 being spaced such that they interact in the cutting operation, with each cutting pick 1 being relieved by the preceding cutting pick 1 in what is known as "relieved cutting". For improved cutting performance, the successive cutting picks 1 are spaced at a ratio relative to the depth of cut of S/D between 1 and 3, as shown in FIG. 7 which defines the spacing S and FIG. 10 which defines the depth of cut D as the distance the rotating drum 10 is advanced in one revolution.

Further, cutting picks 1 may be arranged in a similar lacing pattern on the clearance (Face) ring 12 on the rotating drum 10.

Use of the cutting picks at least described herein, allows advantageous pick performance characteristics, such as: reduction in dust generation due to unchanged rake angle (remains positive) and sharpness of the tip is maintained (self sharpen); lower and more consistent cutting power; decrease coal fragmentation (coarse coal produced); reduced water consumption; reduced wear and tear on cutting machine down-time; less friction between the pick surface and the cutting material thus reducing in frictional sparking; and enhanced health and safety of the mine environment.

Use of the cutting picks 1 as described, allows an improved cutting operation for rock and coal faces 13, producing a coarser product with less airborne dust particles, thereby reducing the health risk to underground miners. The cutting pick 1 configuration is also more efficient in the cutting operation, requiring a lower cutting force and less specific energy to excavate a coal face when compared to the prior art.

Although the invention has been described with reference to specific examples, it would be appreciated by those skilled in the art that the invention may be embodied in many other forms.

The claims defining the invention are as follows:

1. A pick assembly for mounting on a rotatable drum, said drum having a longitudinal axis of rotation, said pick assembly comprising a pick holder and a pick having a longitudinal axis, said pick having:

a non rotating cutting head having a straight cutting edge which delimits substantially planar front and trailing faces of said head;

a securing end engaged within said pick holder to secure said pick relative to said drum so that in use, rotation of said drum drives said cutting edge forward in a generally circular path and so that said pick is prevented from moving substantially relative to said drum; and a shank extending along said longitudinal axis between said cutting head and said securing end, said pick assembly being oriented such that said trailing face is inclined at an acute back clearance angle of about 7 to 15 degrees to a cutting plane, which is defined by a tangent to said circular path at said cutting edge, said front face is inclined at an acute front rake angle of about 10 to 45 degrees to an axis perpendicular to said cutting plane such that said front and trailing faces define an acute angle at said cutting edge, and said cutting edge is maintained in a fixed orientation relative to said drum and substantially parallel to said longitudinal axis; and characterised in that both said front and trailing faces converge outwardly with respect to said drum toward said longitudinal axis of extension and wherein said pick and said pick holder are adapted so that said longitudinal axis is inclined by an acute angle extending rearwardly to said cutting plane.

2. The pick assembly according to claim 1, wherein said shank has a substantially circular cross section and said securing end has a circumferential groove.

3. The pick assembly according to claim 1, wherein securing end has a cross section in the shape of a circle with a segment cut away.

4. The pick assembly according to claim 1, 2, or 3, wherein said pick is manufactured from an air-hardened die cast steel.

5. The pick assembly according to claim 1, 2, or 3, wherein the back clearance angle is between 8 and 10 degrees.

6. The pick assembly according to claim 1, 2 or 3, wherein the rake angle is between 10 and 30 degrees.

7. The pick assembly according to claim 1, 2, or 3, wherein the width of the cutting edge is between 5 millimetres and 60 millimetres.

8. The pick assembly of claim 1, wherein said cutting edge is displaced from said axis of extension.

9. A rotatable drum having at least one pick holder and at least one cutting pick mountable in said pick holder, said pick having a longitudinal axis and including:

a non rotating cutting head having a straight cutting edge which delimits substantially planar front and trailing faces of said head;

a securing end engaged within said pick holder to secure said pick to said drum so that in use, rotation of said drum drives said cutting edge forward in a generally circular path and so that said pick is prevented from moving substantially relative to said drum; and a shank extending along said longitudinal axis between said cutting head and said securing end, said pick being oriented in said pick holder such that said trailing face is inclined at an acute back clearance angle of about 7 to 15 degrees to a cutting plane which is defined by a tangent to said circular path at said cutting edge, said front face is inclined at an acute front rake angle of about 10 to 45 degrees to an axis perpendicular to said cutting plane such that said front and trailing faces define an acute angle at said cutting edge, and said cutting edge is maintained in a fixed orientation relative to said drum and substantially parallel to said longitudinal axis; and characterised in that both said front and trailing faces converge outwardly with respect to said drum toward said longitudinal axis of extension and wherein said pick and said pick holder are adapted so that said longitudinal axis is inclined by an acute angle extending rearwardly to said cutting plane.

* * * * *